US010087563B2

(12) United States Patent
Leco et al.

(10) Patent No.: US 10,087,563 B2
(45) Date of Patent: Oct. 2, 2018

(54) SAFETY DEVICE FOR DETECTION OF A SECURELY CLOSED DOOR OF A DRUM OF A WASHING MACHINE

(71) Applicant: ALLIANCE LAUNDRY CE S.R.O., Pribor (CZ)

(72) Inventors: Tomas Leco, Lucina (CZ); Antonin Bucanek, Odry (CZ); Elias Petr, Koprivnice (CZ); Milan Janicek, Odry (CN)

(73) Assignee: ALLIANCE LAUNDRY CE S.R.O., Pribor (CZ)

( * ) Notice: Subject to any disclaimer, the term of this patent is extended or adjusted under 35 U.S.C. 154(b) by 62 days.

(21) Appl. No.: 15/306,099

(22) PCT Filed: Oct. 13, 2015

(86) PCT No.: PCT/CZ2015/050008
§ 371 (c)(1),
(2) Date: Oct. 23, 2016

(87) PCT Pub. No.: WO2016/180381
PCT Pub. Date: Nov. 17, 2016

(65) Prior Publication Data

US 2017/0138119 A1 May 18, 2017

(30) Foreign Application Priority Data

May 14, 2015 (CZ) ..... 2015-31084

(51) Int. Cl.
*D06F 37/10* (2006.01)
*D06F 39/14* (2006.01)
*D06F 37/42* (2006.01)

(52) U.S. Cl.
CPC ..... *D06F 37/10* (2013.01); *D06F 37/42* (2013.01); *D06F 39/14* (2013.01)

(58) Field of Classification Search
CPC ..... D06F 37/42; D06F 39/14; D06F 37/10; Y10S 292/69
See application file for complete search history.

(56) References Cited

U.S. PATENT DOCUMENTS 4,620,735 A * 11/1986 Heydner ..... D06F 37/42 200/50.1
5,838,125 A * 11/1998 Choi ..... D06F 39/14 318/285

(Continued)

FOREIGN PATENT DOCUMENTS

DE 102013103406 B3 3/2014
EP 1992728 A2 11/2008
EP 2184392 A1 5/2010

*Primary Examiner* — Justin B Rephann
(74) *Attorney, Agent, or Firm* — PROI Intellectual Property US

(57) ABSTRACT

A safety device for detection of a securely closed door of a drum of a washing machine comprises a control unit, at least one electronical sensor interconnected to the control unit, at least one magnetic unit, and at least one lock of the door of the drum of the washing machine, where the safety device further comprises a pivotable lever (7) provided by rotary axis, where at least one magnetic unit (2) is arranged on its one end, and at least one lock (3) of the door of the drum (4) of the washing machine is arranged on its another end, a slipper guide (8) intended to guide the magnetic unit (2) and/or the lever (7), where the slipper guide (8) is provided by at least one blocking protrusion (8*a*, 8*b*), which is intended to hold the lever (7) in closed position.

3 Claims, 2 Drawing Sheets

(56) References Cited

U.S. PATENT DOCUMENTS

| | | | | |
|---|---|---|---|---|
| 5,870,787 | A * | 2/1999 | Choi | D06F 39/14 134/113 |
| 6,886,868 | B2 * | 5/2005 | Hengelein | D06F 37/42 292/201 |
| 8,727,391 | B2 * | 5/2014 | Berginc | A47L 15/4259 292/144 |
| 2002/0101313 | A1 * | 8/2002 | Dirnberger | A47L 15/4259 335/220 |
| 2004/0104580 | A1 * | 6/2004 | Spiessl | D06F 37/42 292/84 |
| 2004/0134239 | A1 | 7/2004 | Hapke | |
| 2007/0108777 | A1 * | 5/2007 | Mueller | D06F 37/42 292/251.5 |

* cited by examiner

SAFETY DEVICE FOR DETECTION OF A SECURELY CLOSED DOOR OF A DRUM OF A WASHING MACHINE

CROSS REFERENCE TO RELATED APPLICATIONS

The present application is the US national stage of International Patent Application PCT/CZ2015/050008 filed on Oct. 13, 2015, which, in turn, claims priority to Czech Patent Application PUV2015-31084 filed on May 14, 2015.

BACKGROUND OF THE INVENTION

The present invention concerns a safety device for detection of a securely closed door of a drum of a washing machine, intended to prevent from its self-opening during washing process.

STATE OF THE ART

In the present time securing of a door of a drum of a washing machine is carried out by mechanical locks, which prevents from self-opening of the door of the washing machine during washing process.

Disadvantage of such solution is, that if the door isn't correctly secured, for an example, because of damage of the lock, because a mechanical part is wore out or because of an improper use, the door of the drum of the washing machine is possible to be opened during the washing process or during the centrifugation process. An effect of such opening can be destruction of the washing machine followed by high cost invested for its reparation and time consumed for its reparation.

In EP 2 184 392 A1 a safety device is presented, which ensures closure of a door of a drum of a washing machine, which is comprising a mechanical lock arranged on the door of the drum, and a control unit intended to check, if the door is correctly closed. The control unit is of a mechanical design. The control unit is a lever. If the lock is closed incorrectly the lock strikes the lever during rotation of the drum. Force of the strike deflects the lever to push the switch. The switch sends a signal to the control unit informing, that the lock is not correctly locked and the washing process is interrupted. The mentioned embodiment consists of multiple items, which are necessary to be produced, installed, adjusted and maintained in a good state. Furthermore, the cover of the drum has to be provided by opening intended to ensure passing of the lever to the washing drum, whereas the opening has to be sealed. Since the lever is movable part of the mechanism, there is a high risk the seal will be in future worn out and water flow out from the washing drum. Adjustment or calibration of such mechanism requires interruption of an operation, unshelled of the cover of the washing machine and tools necessary for the calibration. Self-calibration of the device is not possibility. The main disadvantage of the safety device is its mechanical conception, where mechanical parts can be worn out. It has an impact on the high cost for its maintenance.

In DE 10 2013 103406 B3 a safety device for detection of a securely closed door of a drum of a washing machine is presented. The safety device comprises a control unit, an electronical sensor interconnected to the control unit, a magnetic unit, and a lock of the door of the drum of the washing machine.

The aim of the present invention is to disclose a safety device for detection of a securely closed door of a drum of a washing machine, where the above mentioned disadvantages of the state of the art are eliminated, and door is secured from its self-opening during a washing process.

FEATURE OF THE INVENTION

The above mentioned disadvantages are considerably eliminated by safety device for detection of a securely closed door of a drum of a washing machine where, the safety device comprises a control unit, at least one electronical sensor interconnected to the control unit, at least one magnetic unit, at least one lock of the door of the drum of the washing machine.

In an advantageous embodiment the magnetic unit is a permanent magnet covered by cover.

In another advantageous embodiment at least one magnetic unit is arranged on at least one wing of the door of the washing drum.

In another advantageous embodiment further comprises a lever provided by at least one magnetic unit, where the lever is interconnected to the lock.

In another advantageous embodiment further comprises a slipper guide intended to guide the magnetic unit and/or the lock of the door of the washing drum and/or the lever.

In another advantageous embodiment the slipper guide is provided by at least one blocking protrusion.

DESCRIPTION OF THE DRAWINGS

The invention will be further explained by using the drawings, in which.

FEATURE OF THE INVENTION

Figure 1:
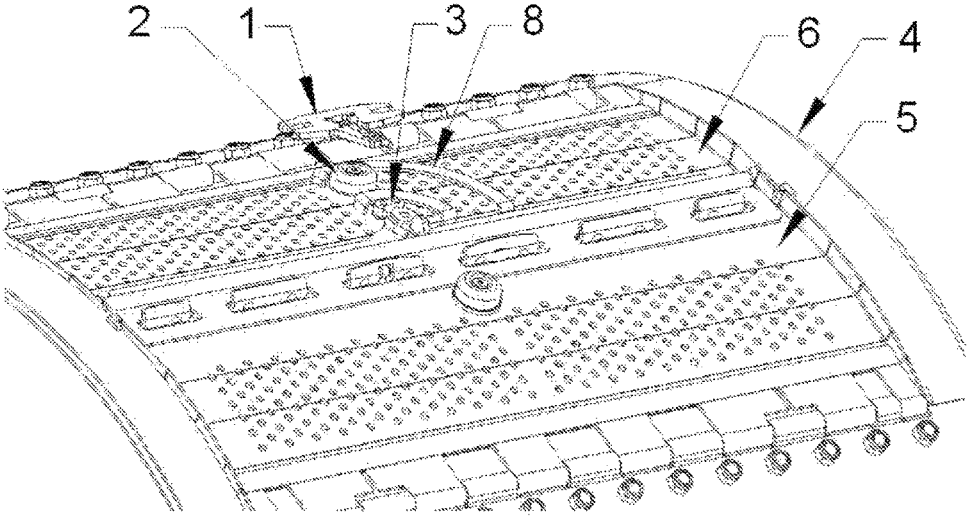
FIG. 1 presents a drum of a washing machine provided by safety device according to the invention.

The safety device for detection of a securely closed door of a drum of a washing machine according to the invention is presented in FIG. 1 comprises at least one electronical sensor 1, at least one magnetic unit 2, at least one lock 3 of the drum of the washing machine and a control unit not presented on the FIG. 1.

Figure 2:
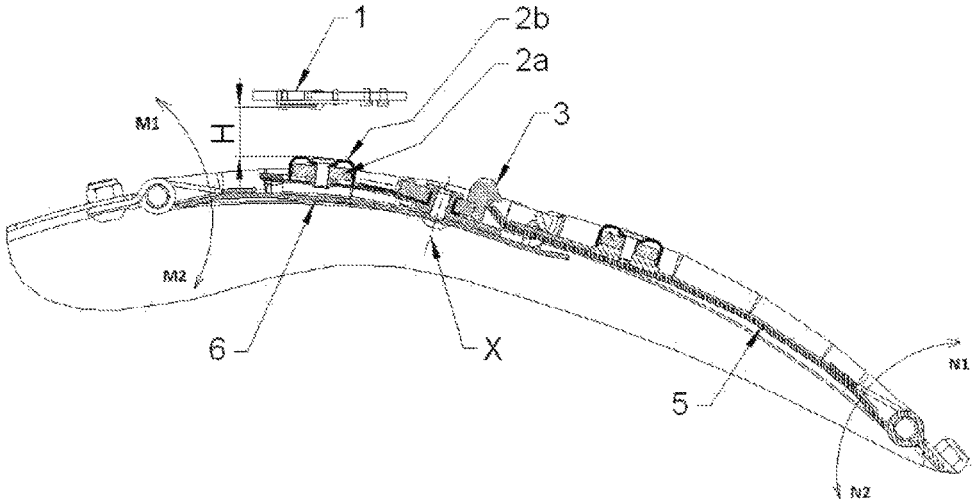
FIG. 2 presents a cross-section of the drum of the washing machine provided by the safety device according to the invention.

The door of the washing drum 4 according to the example is performed as a double wing door, where the first wing 5 of the door is possible to rotate in a direction N1-N2, and the second wing 6 of the door is possible to rotate in a direction M1-M2, see FIG. 2. The door is presented in a closed state.

The magnetic unit 2 comprises for example a permanent magnet 2*a* surrounded by cover 2*b* intended to protect the magnet 2*a* from an external impact and to serve as a handle for manipulation with the lever 7 described below. The magnetic unit 2 is fixed to at least one of the wings 5, 6 of the door of the washing machine 4, for example by screw. The number of the magnetic units 2 depends on the specific technical performance of the mechanical security of the door. The magnetic unit 2 is arranged on the door of the washing drum in such way, that when the door is secured only one position of the magnetic unit 2 with accordance to the sensor 1 is possible.

Figure 3:
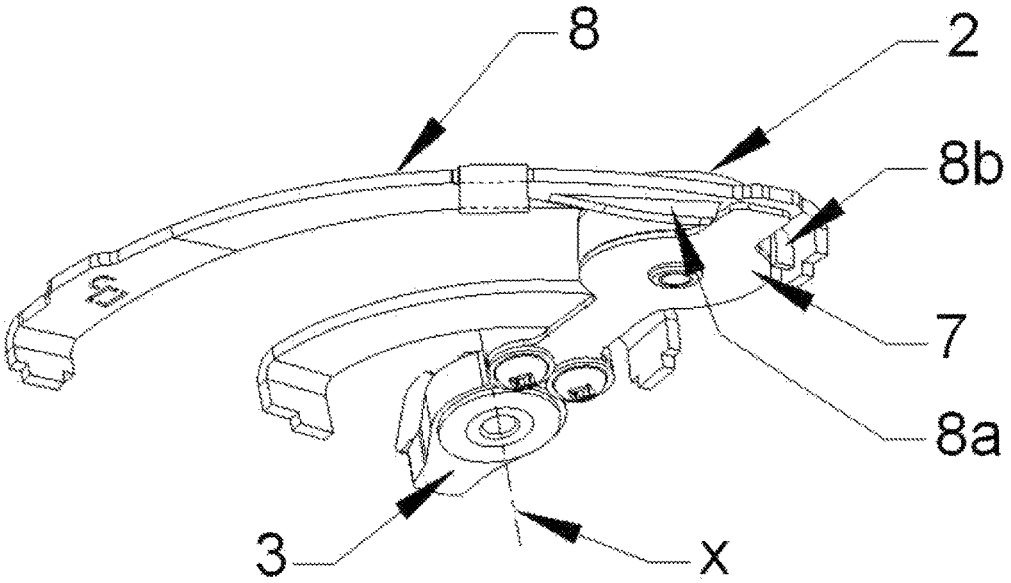
FIG. 3 presents a slippery led lever arranged in the closed state and FIG. 4 presents a slippery led lever in the opened state.

The lock 3 of the wing 5, 6 of the door of the washing drum 6 ensures to set its proper position to prevent its spontaneous opening during washing process. As evident from the FIGS. 3 and 4, the lock 3 is connected to the flexible lever 7, and the end of the lever 7 is provide by the fixed magnetic unit 2. The lever 3, respectively the magnetic unit 2 arranged on the flexible lever 7, is able to rotate around its axis X in the range specified by slipper guide 8. If the lever 7 is in a lock position, as illustrated in FIG. 3, its position is properly specified by at least one blocking protrusion 8*a*, 8*b* and by position of the wing 5, 6 of the door of the washing drum 4. The magnetic unit 2 during rotation of the washing drum 4 moves only on the constant trajectory.

Figure 4:
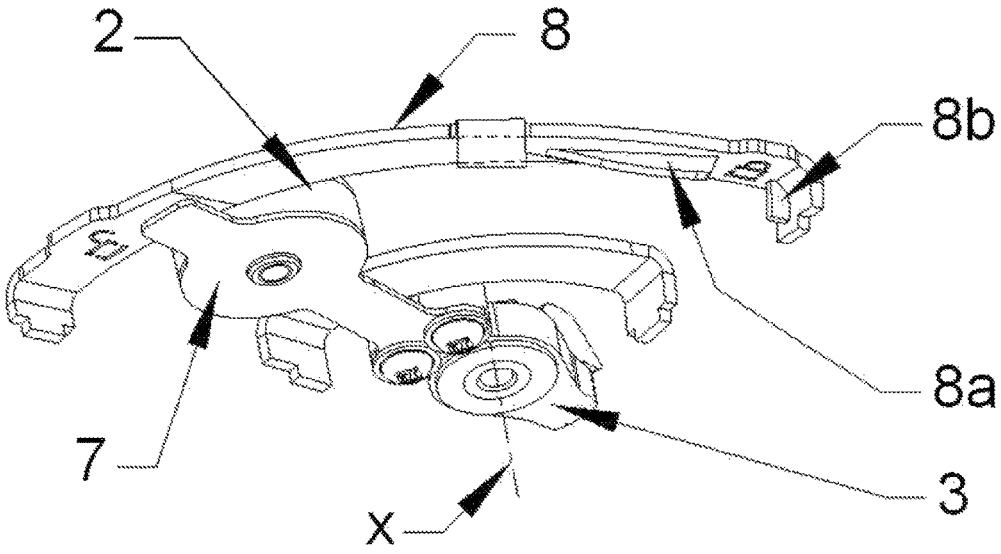

The door of the washing drum 4 is possible to open if the lever 7 is turned to the open position, see FIG. 4. Manipulation with the lever 7 is accomplished by handle, which is in the present embodiment in the form of the cover 2*b* of the magnetic unit 2. In the advantageous embodiment, spontaneous rotation of the lever 7 is prevented by above mentioned blocking protrusions 8*a*, 8*b*. In the locked position the minimum distance between the cover 2*b* and the electronical sensor 1 is the distance H presented in FIG. 2. Because of that, unlock of the lever 7 is possible if the distance H between the cover 2*b* and the electronical sensor 1 is at least higher than the high of the blocking protrusion 8*a*. Switching of the lever 7 from the closed position to the open position is carried out by press of the handle of the lever 7 to spring of the lever 7 to a position, where the lever 7 is not blocked by the blocking protrusion 8*a*. After that the lever 7 is turn able.

The electronic sensor 1 measures magnetic induction of the magnetic unit 2. For example, the electronical sensor 1 is the Hall sensor with sensitivity 5 mV/G, firmly fixed on a suitable place on the outer side of the washing machine and interconnected with the control unit. The control unit communicates in both directions with a control unit of the washing machine.

The value of the magnetic induction measured by the electronic sensor 1 depends on a trajectory of the magnetic unit 2. The closer the magnetic unit 2 is to the electronic sensor 1, the higher the value of the magnetic induction is measured by the electronic sensor 1 and vice versa. The measured value of the magnetic induction is proportional to the voltage measured on the output of the electronic sensor 1. The voltage is evaluated by the control unit.

The control unit is an electronical hardware intended to evaluate an analogical signal measured by the sensor 1. The control unit communicates in both directions with the washing machine and performs a comparison analysis of the measured magnetic induction with a predetermined value recorded in a memory module of the control unit. The predetermined value is obtained by calibration, where the door of the washing drum 4 is professionally closed, and after that the value of the magnetic induction of the magnetic body 2 is measured by sensor 1 during rotation of the washing drum. The control unit formally checks the measured values, evaluates the values and records the values in the memory. The previous data recorded in the memory before will be overwritten by the new one.

If the lever 7 is in an unlocked state, see FIG. 4, or if the lever 7 is situated in some different position instead of the closed position, see FIG. 3, the value of magnetic induction measured by the sensor 1 will differ from the predetermined value recorded in the control unit. The control unit sends the information about the measured value to the control unit of the washing machine.

If the wing 5, 6 of the door of the washing drum 4 is positioned in a correctly closed position and the lock 3 is also correctly locked, the value of the measured magnetic induction will not differ from the predetermined value. Furthermore for this case, the information about the measured value is send to the control unit of the washing machine.

Because of clearance between mechanical parts, the comparing analysis has to tolerate small deviation of the measured values of magnetic induction. As a result of accomplished measurements the convenient margin is the change of mechanical induction corresponding with the change of the position of the magnetic unit 2 less than 1 mm. If the wing 5, 6 of the door of the washing drum 4 in the direction N1-N2 or M1-M2 isn't turned more than 1 mm, the control unit evaluates, that the door is closed correctly and safety and transmits the information to the control unit of the washing machine.

The control unit also considers margin of the distance H between the sensor 1 and the cover 2*b*. The margin has to be less than high of the blocking protrusion 8*a*, 8*b*. In the present embodiment the value of the margin is 1 mm. As a result of that, if the value H is higher than 1 mm the control unit 5 evaluates the door is not secured correctly, and forwards the information to the control unit of the washing machine.

Mounting process of the safety device according to the invention is easy and fast. Its life time is long and an energy consumption in comparison with the consumption of the washing machine is negligible. The presented device is very easy to calibrate, result of that is cost reduction and least time consumed for its service and mounting. During the calibration process there is not necessity to use any tool and also there is not necessity to uncover the washing machine. The calibration process is carried out after the door is professionally secured and the correctness of secured closed door is checked. The measured data gained during the calibration process are recorded in the internal memory and used as predetermined series of the values, which represents correctly secured door. Another advantage of the technical solution is auto-calibration.

Increased certainty of the safety closed door provided by the safety device according to the invention enables safe operation of the washing machine. The safety device according to the invention prevents from self-opening of the door of the drum of the washing machine during washing process. Such self-opening can arise if the lock has a malfunction or if an operator locks the lock not correctly or insufficiently. Because of that the risk of occurrence of an injury of an operator and risk of occurrence of a washing process interruption caused by its malfunction is reduced.

What is to be claimed is:

1. A safety device for detection of a securely closed door of a drum of a washing machine comprises a control unit, at least one electronical sensor interconnected to the control unit, at least one magnetic unit, at least one lock of the door of the drum of the washing machine characterized in that, the safety device further comprises:

a pivotable lever rotational around its rotary axis, where the at least one magnetic unit is arranged on one end of the pivotable lever, and the at least one lock of the door of the drum of the washing machine is arranged on another end of the pivotable lever, a sliding guide configured to guide the magnetic unit and the lever, where:

the sliding guide is provided with at least one blocking protrusion, which is intended to hold the lever in closed position, the electronical sensor is arranged in such position that it measures magnetic induction of the magnetic unit, and the electronical sensor is arranged outside of the drum of the washing machine.

2. A safety device according to the claim 1 characterized in that, the magnetic unit is a permanent magnet covered by cover.

3. A safety device according to the claim 1 characterized in that, at least one magnetic unit is arranged on at least one wing of the door of the washing drum.

* * * * *